United States Patent [19]

Goldhammer

[11] Patent Number: 4,497,247

[45] Date of Patent: Feb. 5, 1985

[54] BALING PRESS WITH VERTICAL OPERATING DIRECTION

[75] Inventor: Albert Goldhammer, Überlingen, Fed. Rep. of Germany

[73] Assignee: Firma Feinwerktechnik Schleicher & Co., Markdoff, Fed. Rep. of Germany

[21] Appl. No.: 362,232

[22] Filed: Mar. 26, 1982

[30] Foreign Application Priority Data

Mar. 31, 1981 [DE] Fed. Rep. of Germany ..... 3112721

[51] Int. Cl.[3] ..... B30B 1/18

[52] U.S. Cl. ..... 100/214; 100/245; 100/290

[58] Field of Search ..... 100/214, 245, 289, 290; 187/24; 254/98; 92/165 R; 15/256.5; 277/53

[56] References Cited

U.S. PATENT DOCUMENTS

| | | | |
|---|---|---|---|
| 791,746 | 6/1905 | Barngrover | 100/214 X |
| 795,147 | 7/1905 | Magoffin | 187/24 X |
| 885,032 | 4/1908 | De Ferranti | 277/53 X |
| 2,857,021 | 10/1958 | Kinsman | 187/24 X |
| 2,908,408 | 10/1959 | Reed | 187/24 X |
| 3,688,920 | 9/1972 | Frish | 187/24 X |
| 3,762,312 | 10/1973 | Guhl | 100/245 X |
| 3,827,347 | 8/1974 | Gilman | 100/290 X |
| 3,862,595 | 1/1975 | Longo | 100/289 X |
| 4,013,181 | 3/1977 | Johnson | 100/245 X |

*Primary Examiner*—Billy J. Wilhite

*Attorney, Agent, or Firm*—Lackenbach Siegel Marzullo Presta & Aronson

[57] ABSTRACT

An improved baling press with a vertical operating direction and with a press plate guided within a press case by means of rollers and cooperating coordinated guides, and with the press plate being solidly connected to spindle nuts, which in each case are crossed through by a driven press spindle; the baling press permitting the guiding of the press plate of the press case only along one wall thereof, while the other walls with the exception of the wall disposed above or below the drive are available for other use, such as corresponding feed openings. Thus, the guiding of the press plate of the press case is only along one wall of the press case, preferably the rear wall thereof.

7 Claims, 4 Drawing Figures

BALING PRESS WITH VERTICAL OPERATING DIRECTION

The invention relates to a baling press with vertical operating direction with a press slidably guided in a press case via rollers and coordinated guides, which press plate is solidly connected to spindle nuts, which in each case are run through by a rotation driven press spindle.

In conventional press spindles only one side either in front, on the side, on top or at the bottom was provided for the feeding of the material to be pressed.

If one wishes to employ such baling presses for example in the chemical industries where mainly foams, vapors and in particular agressive dusts are present, then the path from the comminution apparatus, that is, for example, from the paper shredder to the filling into the baling press is so long, that under certain circumstances health hazards to the operating persons are unavoidable, or, however, vapors, which are generally aggressive, emitted in the neighborhood lead to destruction.

It is an object of the invention to provide a baling press such that at one or two side walls an additional peripheral piece of equipment can be connected, for example, paper shedders or comminution equipment, from which then immediately the comminuted material falls into the filling shaft or is pushed into it. It is also possible to position suction devices in the baling press space, in order to avoid any damaging effect to the environment.

It is another object of the invention to provide a baling press such that the drive of the press plate and its guiding are disposed only in one limiting face of the baling press, while the other limiting faces are available for the peripheral equipment, suction devices, filling shafts and the like.

Starting from a baling press of the kind initially mentioned the object of the invention is achieved by providing the guiding of the press plate at the press case along only one wall of the press case.

A preferred embodiment comprises that the guide of the press plate is provided at the rear wall of the press case.

It is important in order to achieve high press pressures that the guiding of the press plate is provided in a vertically within U-rails of a shiftable carriage along the rear wall of the press case, which rolls with its rollers in the U-profile of the rails.

Such roller guides thus have to accept vertical and combined forces, since at one side guiding bending loads will occur.

A particularly preferred embodiment of a roller construction, which serves this purpose comprises roller guiding of the carriage in the U-rails with four rollers which are disposed at the carriage with a vertical and horizontal distance with a horizontal axis that in each case in the axes of the rollers a seat in which is disposed a further roller with a horizontal axis, which axis is disposed vertically to the axis of the other roller.

By disposing the rollers running with respect to each other in vertical planes at a very small distance from each othera favorable transfer is provided of the load stresses onto the roller guiding.

In this context it is essential that on the two sides of the press plate there is disposed a horizontal traverse, which crosses in each case through a vertical slot sealed with a brush into the back wall of the press case and is connected to the carriage.

This construction prevents the entering of dust and waste material into the guiding of the rollers.

It is also important that the horizontal traverse is provided with a triangular cross-section.

This embodiment is important in order to transfer large press pressures with low bending torques from the spindle onto the material to be pressed.

It is a further feature of the invention that each press spindle is connected to a chain wheel fixed with regard to rotation at its lower free end, and in which a chain drive runs connecting the chain wheels and the chain wheel of the drive motor.

The drive via chain wheels and chain drive assures that there is always a synchronous drive of the two spindles present, so that a canting cannot occur.

It is further important for the transfer of the load that the spindle nut is disposed between the press face of the press carriage and the lower roller guiding, formed by the rollers.

The power transfer from the rotating spindle to the press plate is disposed at this position and at the disposition is possible with the lowest bending load stress, such that with a relatively small power expenditure large press pressures can be exerted.

It is yet further important that relative to the width of the press plate the roller guidance formed by the corresponding rollers on the outside protrudes beyond the width of the press plate, while the press spindles are diposed inside or between the outer limits of the press plate.

The outside disposed roller guiding certainly will balance possible bending loads, which can occur based on a nonuniform distribution of the materials to be pressed. The press spindles driven and disposed at a relatively short distance from each other assure that a quiet run of the press is achieved without any rattling thereof. The above features as well as the details of the invention will be seen in the foregoing description when taken with the accompanying drawings which illustrate the present invention.

Figure 1:
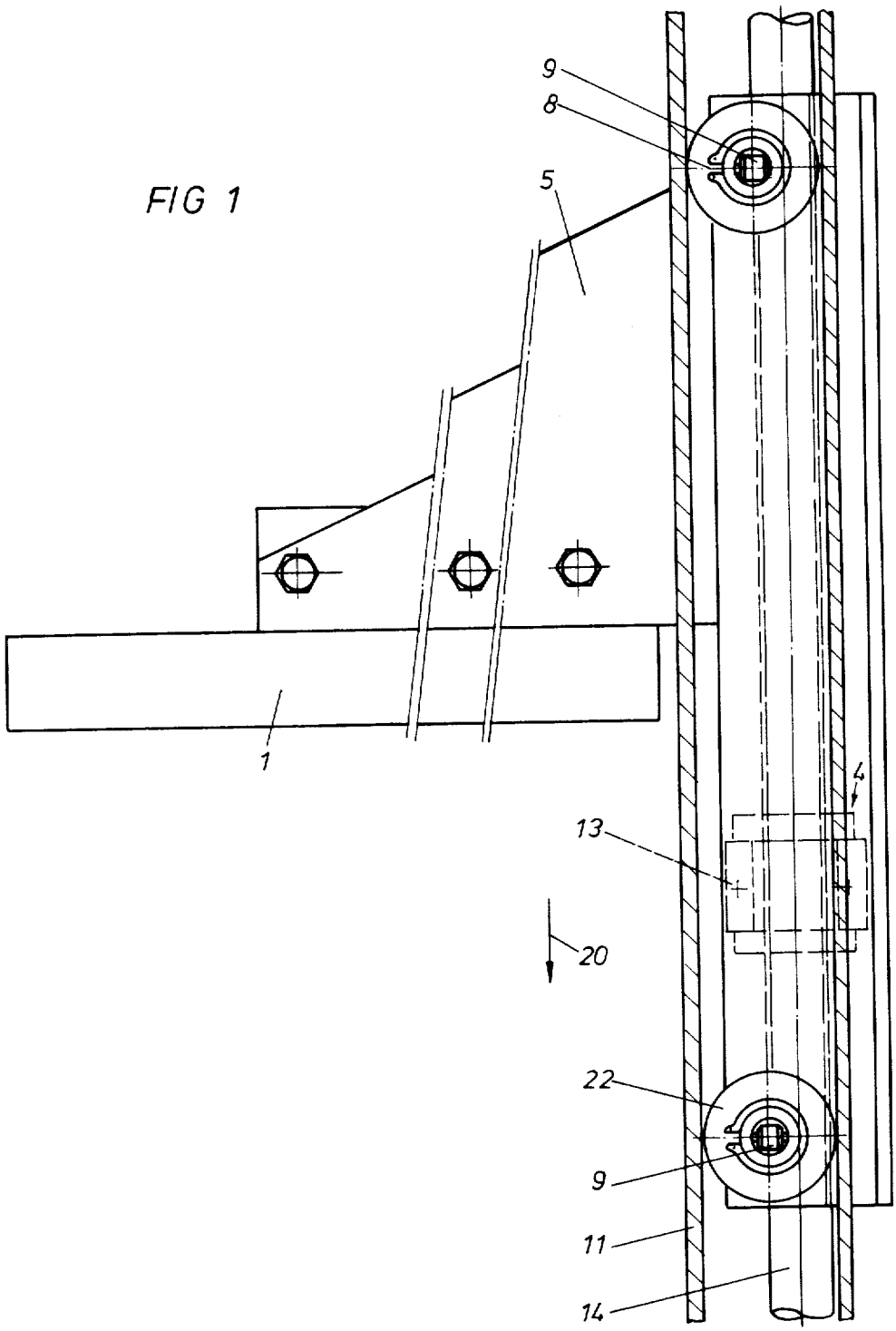
FIG. 1 shows a front view of the press plate with roller guiding and drive with only the most important individual parts.
Figure 2:
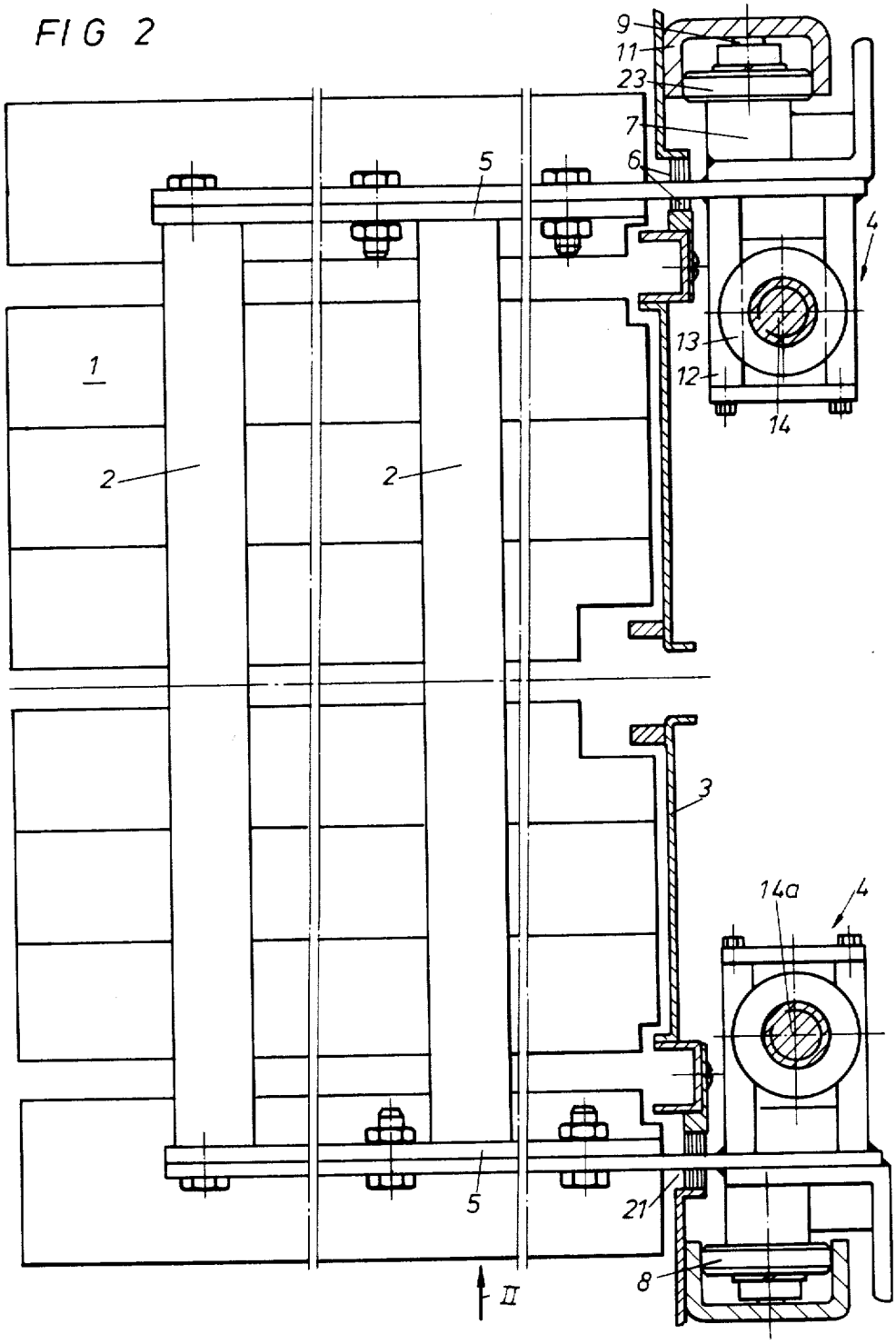
FIG. 2 is a plan view onto the embodiment of FIG. 1.
Figure 3:
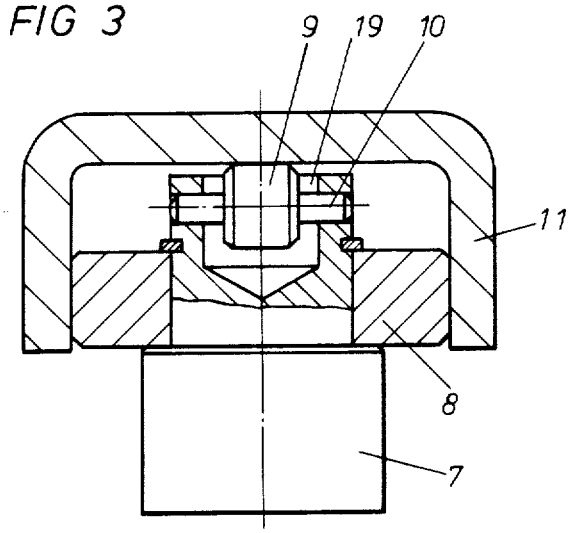
FIG. 3 shows an enlarged view of the roller guiding at one point as a detail.

The press plate is held together at the upper side with the U-traverse 2 as is shown in particular in FIG. 2. The guide of this press carriage is provided at the rear wall 3 of the case. Here this rear wall 3 is only shown in part in the drawing; and the case also includes side walls and a front wall.

The guide of the press plate 1 is provided by a vertically shiftable carriage 4 linked to the rear wall. The press plate 1 crosses with its traverses 5 through the rear wall of the case.

Brushes 6 disposed in this passage opening serve to provide sealing. A bolt 7 protruding to the outside is attached to the cross traverse 5 and roller 8 which is situated on top and roller 22 situated at the bottom are rotatably fastened to the bolt 7.

In total, there are four bolts 7, which carry the roller 8, 22 or respectively 23.

The bolt 7 is provided at its ends disposed toward the outside, with axles 10, where the middle line of the axis 10 runs vertically to the middle line of the bolt 7. A futher roller 9 is disposed on the axis 10 and the rollers 8, 9, 22, 23 roll along the guiding rails 11. The guiding rails 11 are solidly connected to the case or respectively to the rear wall 3. Thus, the press carriage 1 is safely guided by way of roller guiding in the horizontal and in the vertical direction, whereby a canting is not possible.

The vertical upward and downward motion of the complete carriage 4 is provided via spindle nuts 13, which are connected to the carriage 4.

Figure 4:
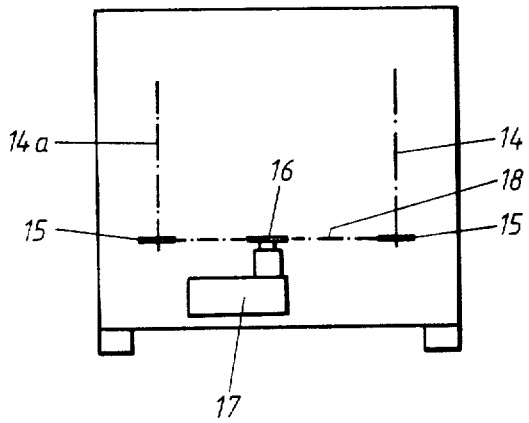
FIG. 4 is a schematic view of the chain drive and chain wheels.

These spindle nuts 13 are permeated by press spindles 14 and respectively 14*a* as is shown in particular in FIG. 4 and as there is indicated schematically the chain wheels 15 are solidly connected to the press spindle 14, 14*a* depending on if one desires the drive on the top or at the bottom. In the embodiment the drive is at the bottom. The drive motor 17 in turn comprises itself a chain wheel 16, which is the drive wheel, and then the motor 17 drives the press spindles 14, 14*a* via a chain drive in such a direction of rotation, that the press plate 1 is moved either in the direction of arrow 20 or opposite to the direction of the arrow 20.

The recess 21 is covered with brushes as was mentioned already above.

Further, it is important with this embodiment that one can achieve a pressure power of 6 tons with a 2.2 kilowatt drive motor and this full power is transferred from one wall, while the other walls with the exception of the wall disposed below or the wall disposed above the drive are available for other peripheral aggregates or corresponding feed openings.

Advantageously, a drive disposed in the floor of the press, thereby results in a particularly advantageous equilibrium distribution and the operation of the press is particularly simple, since the filling area with its filling shaft are now disposed higher up in comparison with presses having a drive disposed at the top and where the feed shaft is located at about the level of the chest of the user, such that the user can fill in without particular exertion of force the waste and the material to be pressed.

Although the present invention has been described in some detail by way of illustration and example for purposes of clarity of understanding, it will, of course, be understood that various changes and modifications may be made in the form, details, and arrangements of the arts without departing from the scope of the invention as set forth in the following claims.

I claim:

1. An improved baling press with a vertical operating direction comprising:

a press case having side walls, a front wall and a rear wall which is substantially closed but provided with two vertical slots:

a carriage means including rollers and guide rails;

a press plate movable up and down in said press case; and two transverse elements connected at the upper side of said press plate and secured to said carriage means, which is vertically guided by said rollers cooperating with said guide rails mounted behind said rear wall;

spindle nuts secured to said carriage means;

two vertical press spindles rotatably mounted behind said rear wall of said press case, spaced from each other in a direction parallel to said rear wall and cooperating with said spindle nuts to move said carriage means and said press plate;

a motor having an output shaft driveably connected to said spindles by sprocket wheels fastened on said output shaft and each of said two vertical press spindles;

a single drive chain connecting all of said sprocket wheels and connecting said motor and both of said two vertical press spindles, whereby both spindles are driven in synchronism and in the same rotating direction;

said transverse elements projecting through said two vertical slots in said rear wall; and flexible sealing means projecting into said vertical slots of said rear wall in order to prevent material to be baled from falling out of said press case through the slots.

2. The improved baling press according to claim 1, wherein the guiding of the press plate is provided by said carriage means slideable vertically along the rear wall of said press case within guide U-rails, and said carriage means rolls with its rollers along the profile of the rails.

3. The improved baling press according to claim 2, wherein a roller guide in the guide-rails includes four rollers disposed on the carriage means with a horizontal and vertical distance with a horizontal axis that in each case in the axes of the rollers is disposed a seat for a further roller with a horizontal rotation axis, which axis is disposed vertically to the rotation axis of said other rollers.

4. The improved baling press according to claim 1, wherein said flexible sealing means comprises brush means connected to said carriage.

5. The improved baling press according to claim 4, wherein said traverse elements are provided with a triangular cross-section.

6. The improved baling press according to claim 1, wherein said spindle nuts are disposed between the press plate and said guide rails.

7. The improved baling press according to claim 1, wherein said rollers protrude beyond the width of the press plate, and said spindles are disposed within the width of said press plate.

* * * * *